US006712134B2

(12) United States Patent
Stoesz

(10) Patent No.: US 6,712,134 B2
(45) Date of Patent: Mar. 30, 2004

(54) MODULAR BI-DIRECTIONAL HYDRAULIC JAR WITH ROTATING CAPABILITY

(75) Inventor: Carl W. Stoesz, Pasadena, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/074,523

(22) Filed: Feb. 12, 2002

(65) Prior Publication Data

US 2003/0150609 A1 Aug. 14, 2003

(51) Int. Cl.[7] ..... E21B 31/107; E21B 31/113; E21B 10/36; E21B 4/14

(52) U.S. Cl. ..... 166/178; 166/237; 166/301; 175/296

(58) Field of Search ..... 175/296; 166/381, 166/383, 386, 373, 301, 153, 154, 155, 156, 178, 237, 238, 332.1, 334.1, 177.6

(56) References Cited

U.S. PATENT DOCUMENTS

| | | | | | |
|---|---|---|---|---|---|
| 2,758,817 | A | | 8/1956 | Bassinger | |
| 3,361,220 | A | | 1/1968 | Brown | |
| 4,076,086 | A | | 2/1978 | Evans | |
| 4,361,195 | A | | 11/1982 | Evans | |
| 4,462,471 | A | | 7/1984 | Hipp | |
| 4,506,742 | A | | 3/1985 | Fukase | |
| 4,582,148 | A | * | 4/1986 | Walter | 175/297 |
| 4,862,976 | A | * | 9/1989 | Meek | 175/296 |
| 4,865,125 | A | | 9/1989 | De Cuir | |
| 4,958,691 | A | * | 9/1990 | Hipp | 175/296 |
| 5,086,853 | A | | 2/1992 | Evans | |
| 5,156,223 | A | * | 10/1992 | Hipp | 175/296 |
| 5,174,393 | A | | 12/1992 | Roberts et al. | |
| 5,217,070 | A | | 6/1993 | Anderson | |
| 5,232,060 | A | | 8/1993 | Evans | |
| 5,259,467 | A | * | 11/1993 | Schoeffler | 175/38 |
| 5,404,944 | A | * | 4/1995 | Lynde et al. | 166/117.7 |
| 5,803,182 | A | | 9/1998 | Bakke | |
| 5,984,028 | A | * | 11/1999 | Wilson | 175/297 |
| 6,035,954 | A | | 3/2000 | Hipp | |
| 6,062,324 | A | | 5/2000 | Hipp | |
| 6,164,393 | A | | 12/2000 | Bakke | |
| 6,182,775 | B1 | * | 2/2001 | Hipp | 175/296 |
| 6,202,767 | B1 | * | 3/2001 | Friis | 175/297 |
| 6,206,101 | B1 | | 3/2001 | Bakke | |

* cited by examiner

*Primary Examiner*—David Bagnell
*Assistant Examiner*—Jennifer H Gay
(74) *Attorney, Agent, or Firm*—Steve Rosenblatt

(57) ABSTRACT

A bi-directional jar with bit turning capability jars down when weight is set down on the tool and pressure is built up on a piston to move the body up while compressing a spring. When spring force opens the valve in the piston, the housing comes down striking an anvil as the flow rushes through the piston before the valve recluses for another cycle. The valve member features a hydraulic brake to slow its movement after the valve is forced open. Clutching action comes from an angled spline acting through a spirally cut cylinder, which reduces in diameter to engage the bit to turn. A single spring acts on a pair of pistons for bi-directional jarring. Modularity allows rapid conversion to uni-directional operation.

17 Claims, 7 Drawing Sheets

MODULAR BI-DIRECTIONAL HYDRAULIC JAR WITH ROTATING CAPABILITY

FIELD OF THE INVENTION

The field of this invention is jars for downhole use in operations such as drilling and fishing and more particularly to fluid operated jars that function bi-directionally.

BACKGROUND OF THE INVENTION

Jars are downhole devices that are used to impart a blow in an uphole or downhole direction to a stuck object. They have also been designed to impart rotary motion so that a drill bit can be turned as well as hammered during a drilling operation. There are the purely mechanical types that deliver a fixed jarring force triggered by pulling up on the string. There are hydraulic versions that generally have two telescoping members with fluid reservoirs annularly disposed in between. A small orifice through which the oil has to pass resists the initial pulling of the string. This passage is in a movable piston that isolates the two annular cavities as the pulling force is applied. Eventually, the movable piston with the orifice in it clears a narrow passage allowing oil to rush around it and allowing the telescoping members to contact each other to deliver a hammer blow to an anvil.

Yet other designs of jars have used the concept of valves in pistons, which when closed allow pressure buildup to move telescoping members with respect to each other and against the force of a spring. As more relative movement under these conditions occurs, the spring force eventually overcomes the hydraulic force holding the valve in the piston closed and the movement of the telescoping members is violently reversed. This results in a hammer blow delivered to an anvil as the tool reassumed the initial position for a repetition of the same cycle. A good example of this style of bi-directional jar is U.S. Pat. No. 5,803,182. While this design can hammer bi-directionally, it did not have the capability of also delivering rotary motion to a drill bit. Another example of a bi-directional hydraulic jar is U.S. Pat. No. 4,462,471.

Prior attempts to provide bit turning capability to jars involved the provision of a pin extending in a spiral slot to convert axial movement in the jar to a rotational output at the bit secures at its lower end. An example of this design is U.S. Pat. No. 4,958,691. It features the use of a plurality of tilting cams to insure rotation in a single direction for drilling. This tool did not have bi-directional capability and the mechanical reliability of the arrangement of the pin in the spiral slot was less than ideal.

The present invention addresses the limitations of the prior designs and seeks to accomplish a variety of objectives in a single tool, some of which will be enumerated. The jar of the present invention delivers bi-directional jarring capability in conjunction with the ability to impart rotational motion for drilling. The clutching system addresses the reliability issue in a drilling environment. Cushioning members reduce wear on valve seats from cyclical loading. Modularity allows for rapid conversion from bi-directional operation to unidirectional operation. Use of a singular spring system for jarring in opposite direction and other features allow reduction of overall length of the jar, in comparison to existing bi-directional jars. The number of parts is also reduced to aid the objective of reliability and overall length reduction. These and other objectives will be more apparent to a person skilled in this art from a review of the detailed description of the preferred embodiment described below.

Also relevant for background in the field of downhole jars are U.S. Pat. Nos. 4,076,086; 4,361,195; 4,865,125; 5,086,853; 5,174,393; 5,217,070; 4,462,471; 6,062,324; 6,035,954; 6,164,393; and 6,206,101.

SUMMARY OF THE INVENTION

A bi-directional jar with bit turning capability is disclosed. To jar down, weight is set down on the tool and pressure is built up on a piston to move the body up while compressing a spring. When spring force opens the valve in the piston, the housing comes down striking an anvil as the flow rushes through the piston before the valve recloses for another cycle. The valve member features a hydraulic brake to slow its movement after the valve is forced open. Clutching action comes from an angled spline acting through a spirally cut cylinder, which reduces in diameter to engage the bit to turn. A single spring acts on a pair of pistons for bi-directional jarring. Modularity allows rapid conversion to uni-directional operation.

DETAILED DESCRIPTION OF THE PREFERRED EMBODIMENT

Figure 1A:
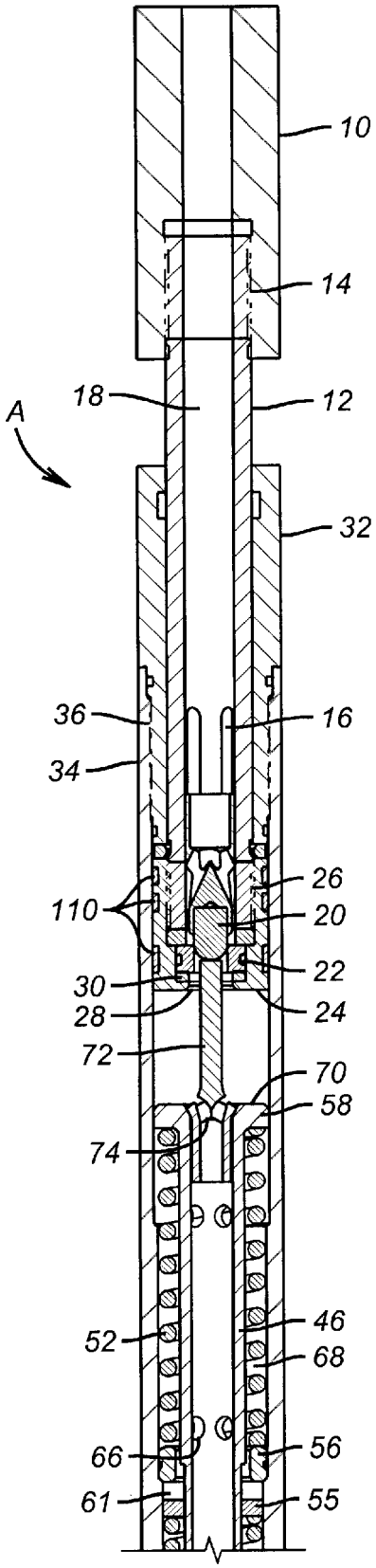
FIGS. 1*a*–1*c* are a sectional elevation of the jar in the run in mode or in the ready for up impact mode.
Figure 1B:
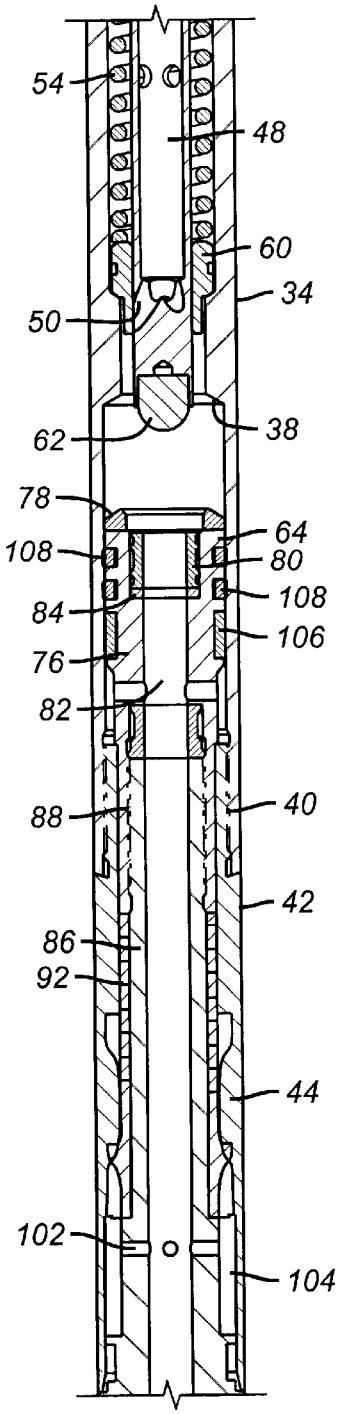
Figure 1C:
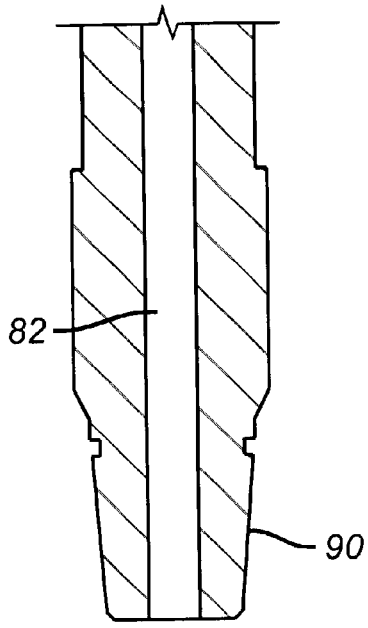

Referring to FIGS. 1*a*–1*c*, the apparatus A has a top sub 10 to which a tubing string (not shown) of coiled or rigid tubing can be attached. Upper shaft 12 is secured to top sub 10 at thread 14. A plurality of elongated slots 16 are aligned with the longitudinal axis of upper shaft 12 to allow flow in passage 18 to pass around valve member 20 when valve member 20 is off of upper seat 22, as will be explained below. Impact cap 24 is secured to upper shaft 12 at thread 26. An opening 28 is in the lower end of impact cap 24. Upper seat 22 surrounds opening 28 inside of impact cap 24. A shock-absorbing ring 30 is sandwiched between upper seat 22 and impact cap 24. Ring 30 also surrounds the opening 28 in its position below upper seat 22. Valve member 20 is slidably mounted in passage 18 and during the run in position can fall toward its ultimate position against upper seat 22. It may stop short of upper seat 22, but, for up jarring with tension applied to top sub 10, fluid pressure in passage 18 will ultimately seat valve member 20 on upper seat 22. During down jarring, slots 16 will permit flow to bypass valve member 20 through open opening 28 on impact cap 24.

Mounted around upper shaft 12 is upper sub 32. Upper sub 32 is connected to main barrel 34 at thread 36. Main barrel 34 has an impact shoulder 38 (FIG. 1*b*) and a thread 40 to attach the helix housing 42 at its lower end. Helix housing 42 has an internal helix 44, see FIG. 8, whose purpose will be explained below.

Within main barrel 34 is dart body 46. Dart body 46 has a central passage 48 that terminates in one or more lateral outlets 50. Surrounding dart body 46 are springs 52 and 54. Spring perch 56 is supported off a shoulder on main barrel 34 and acts as the lower support for spring 52. An upper flange 58 on dart body 46 rests on spring 52 during run in. Dart bushing 60 rests on another internal shoulder in main barrel 34 and supports the lower end of spring 54. Mounted above spring 54 is trip bushing 61. Trip bushing 61 is designed to move up into contact with spring perch 56 when upward movement of the main barrel 34 urges dart bushing 60 upwardly, as will be explained below. A carbide insert 62 acts as a lower valve member when disposed against seat 64, as will be explained below. A series of openings 66 allow springs 52 and 54 to compress without fluid resistance of a pressure buildup in annular space 68. A tappet 70 is secured at the top of passage 48. Tappet 70 has an extending pin 72 around which flow can enter passage 48 through passage 74 in tappet 70. During run in, valve member 20 rests on pin 72. For up jarring, valve member 20 is seated against upper seat 22. Ultimately, pin 72 will force valve member 20 off upper seat 22 to deliver an up jarring force, as will be explained below.

Also mounted in main barrel 34 is piston 76, which supports impact ring 78. Annular seat 80 surrounds passage 82 through piston 76. Shock absorbing ring 84 supports annular seat 80 against shock from contact by carbide insert 62, as will be explained below. Shaft 86 is connected to piston 76 at thread 88. Shaft 86 continues passage 82 to the lower end 90 where a drill bit can be connected for drilling or where the apparatus A can be attached directly or indirectly to a stuck object downhole for up and/or down jarring blows.

Figure 7:
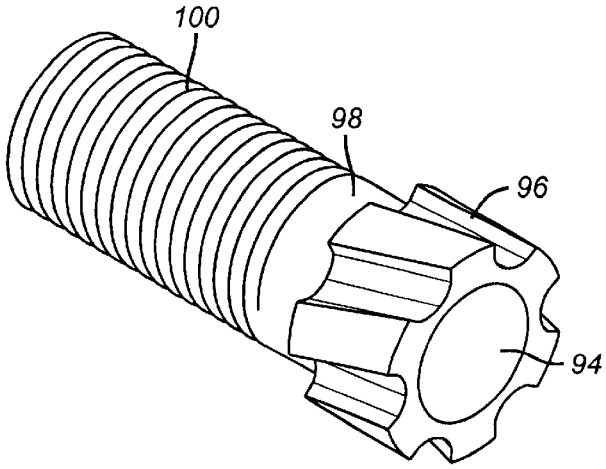
FIG. 7 is a perspective view of the clutch showing the spline drive.
Figure 8:
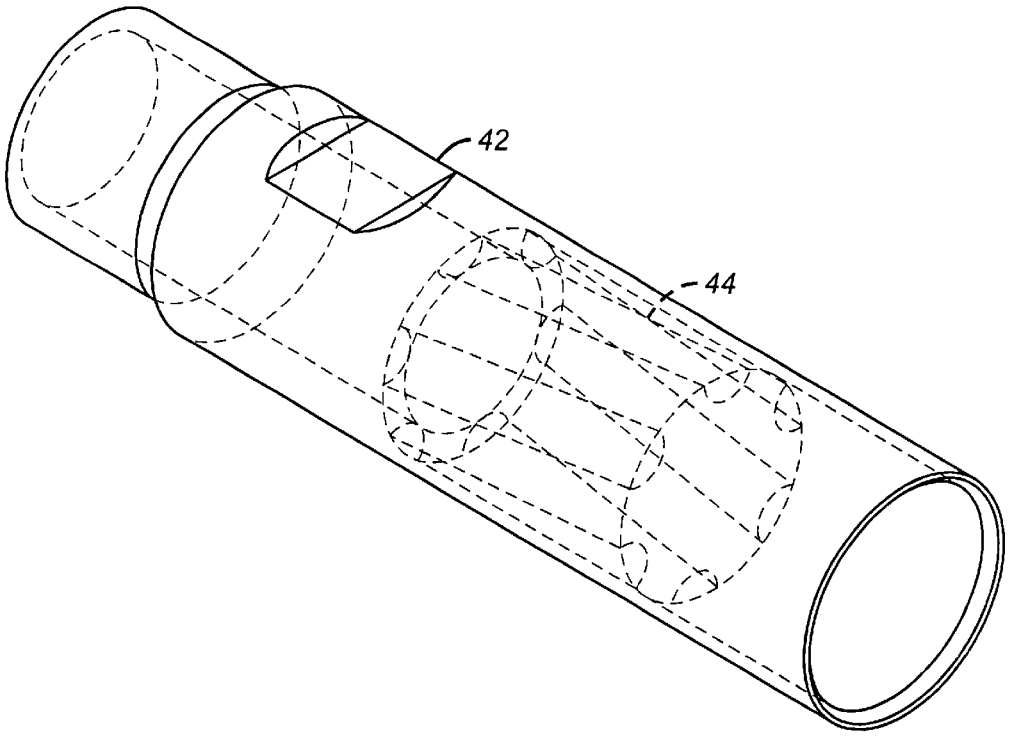
FIG. 8 is a perspective of the helix housing showing the internal teeth in hidden lines.

A coil clutch 92 is disposed between helix housing 42 and shaft 86. FIG. 7 illustrates a perspective view of coil clutch 92. It has a central passage 94 so it can be mounted over shaft 86. It has a helical spline 96 that meshes with helix 44 on helix housing 42. FIG. 8 shows in dashed lines the internal helix or spline 44 that meshes with the helical spline 96 on coil clutch 92. Referring again to FIG. 7, the coil clutch has a cylindrical body 98 that is spirally cut in one or more spirals 100. When helix housing 42 moves up the meshing of helical spline 96 with spline 44 causes rotation of coil clutch 92 in a direction that tends to expand the diameter of the spiral 100. What this does is prevent engagement of shaft 86 by spiral 100. When the helix housing 42 comes back down, it turns the coil clutch 92 in the opposite direction causing the spiral 100 to constrict around shaft 86. The downward motion of helix housing 42, which is prevented from rotation on its axis by keying upper sub 32 to upper shaft 12 (keying feature not shown), through the engagement of splines 96 and 44, imparts a rotation to the coil clutch 92, now securely grabbing the shaft 86. As a result, the shaft 86 rotates and eventually receives a downward jarring blow when impact shoulder 38 strikes impact ring 78, as will be explained below.

Passages 102 prevent liquid lock in annular space 104 due to relative movement of the helix housing with respect to shaft 86. Bushing 106 allows the shaft 86 to turn in helix housing 42 with reduced wear. Seals 108 seal between piston 76 and main barrel 34 to facilitate pressure buildup on piston 76 when carbide insert 62 has landed on it. Seals 110 seal between impact cap 24 and main barrel 34.

Figure 2A:
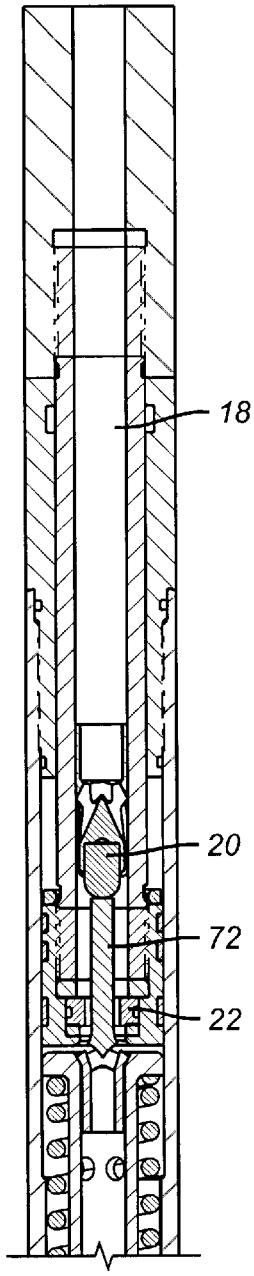
FIGS. 2*a*–2*c* are the view of the jar in the ready for down impact mode.
Figure 3A:
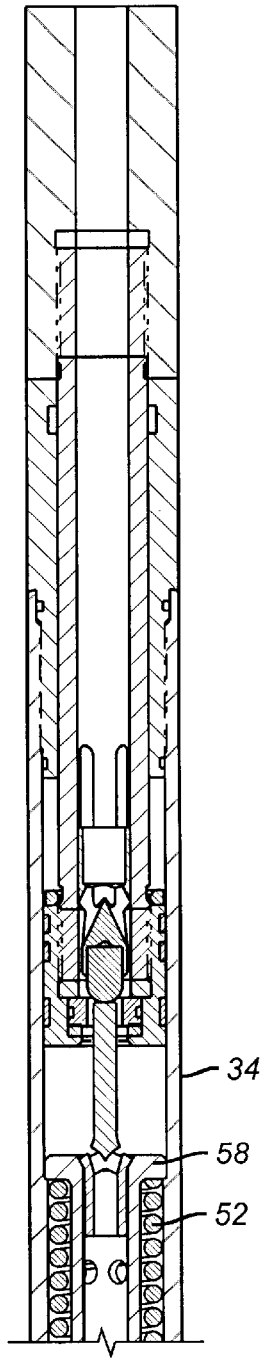
FIGS. 3*a*–3*c* are the position subsequent to FIGS. 2*a*–2*c* after pressure buildup but before delivery of the downward jarring blow.
Figure 2B:
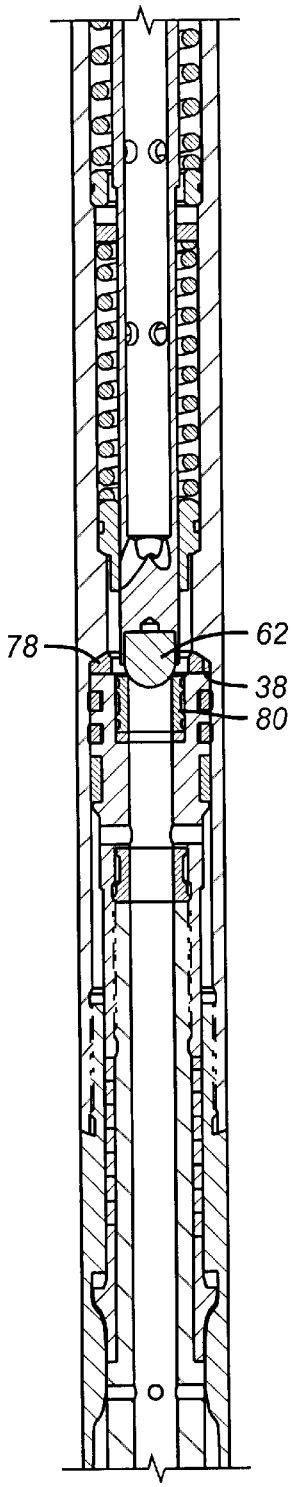
Figure 3B:
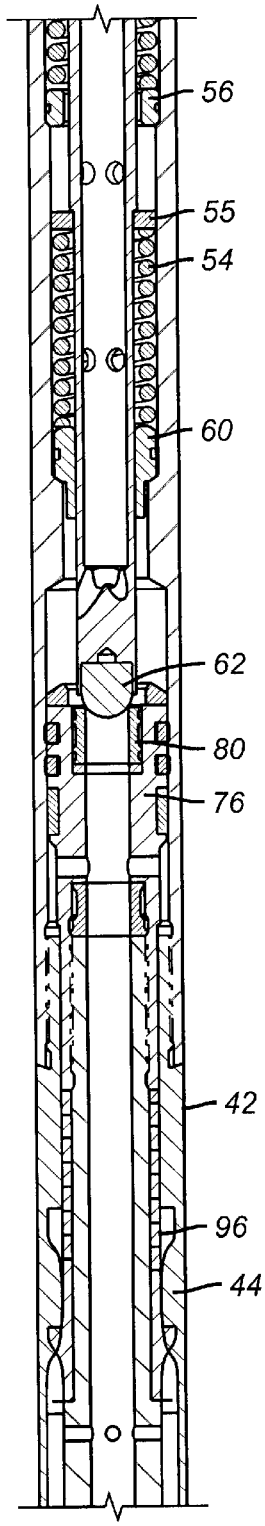
Figure 2C:
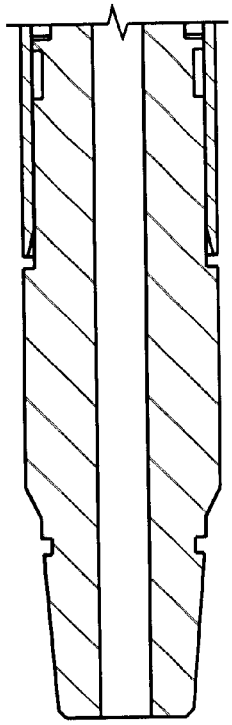
Figure 3C:
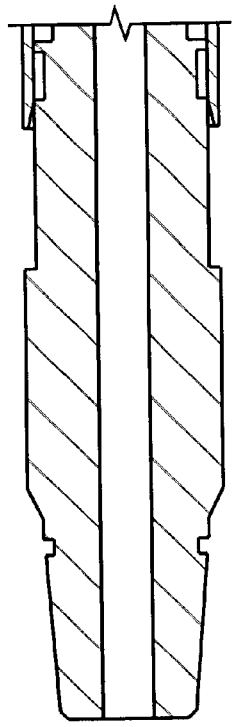

The main parts now having been described, the operation of the tool will now be reviewed. To jar down and rotate shaft 86, weight is set down on top sub 10 with the bit (not shown) attached at lower end 90. As shown in FIGS. 2*a*–2*c*, setting down weight allows pin 72 to displace valve member 20 from upper seat 22 and flow to bypass valve member 20 through slots 16 and out through opening 28. Carbide insert 62 is advanced into close proximity of seat 80 or may even land on it. If contact is not made just from setting down, the onset of pressure into passage 18 will push carbide insert 62 into contact with seat 80. Pressure builds on piston 76 which can't move down, so the pressure drives up main barrel 34, as shown in FIGS. 3*a*–3*c*. Pressure maintains the dart body 46 against piston 76 up to a point. Dart bushing 60 is moved up with main barrel 34 to compress spring 54 against a travel stop 55 supported from dart body 46, only after stop 55 engages a shoulder 57 on dart body 46. However, before that can happen, spring perch 56 compresses spring 52 against flange 58 on dart body 46. Upward movement of helix housing 42 turns the coil clutch due to the meshing of splines 96 and 44. When helix housing 42 moves up, spiral 100 does not grab shaft 86 so that the coil clutch simply turns with respect to shaft 86.

Figure 4A:
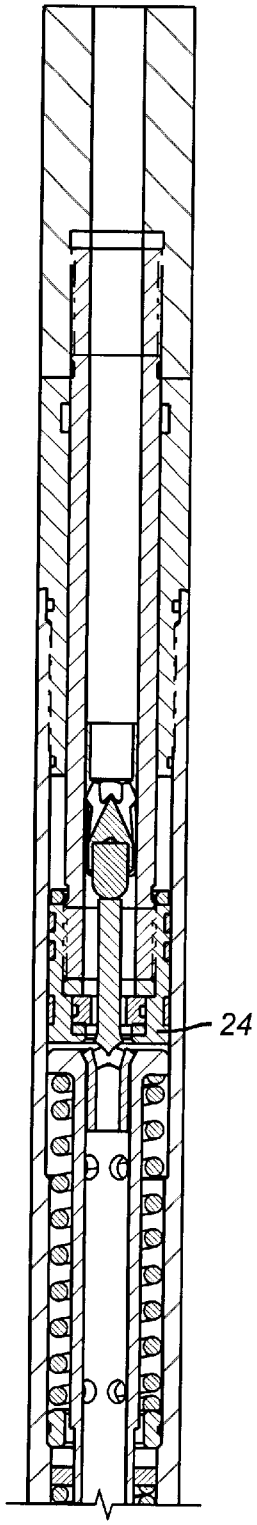
FIGS. 4*a*–4*c* are subsequent to the position of FIGS. 3*a*–3*c* with the valve open in the piston but prior to the delivery of the jarring impact.
Figure 5A:
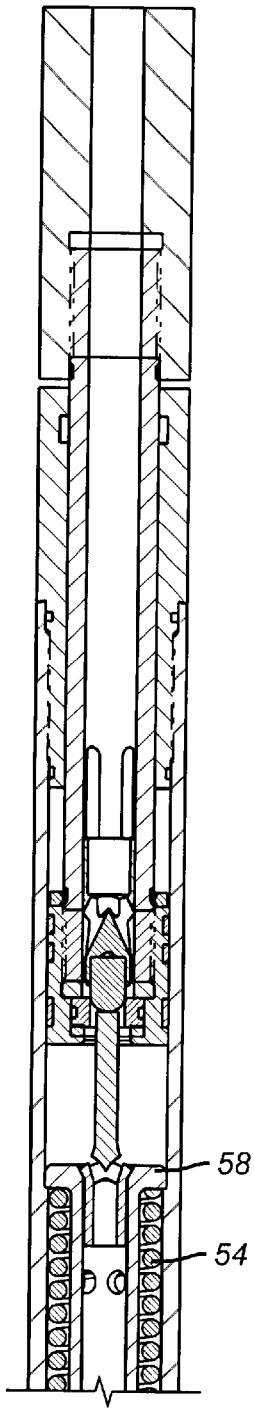
FIGS. 5*a*–5*c* are the up impact position shown in FIGS. 1*a*–1*c* but after pressure buildup but before delivery of the upward jarring blow.
Figure 4B:
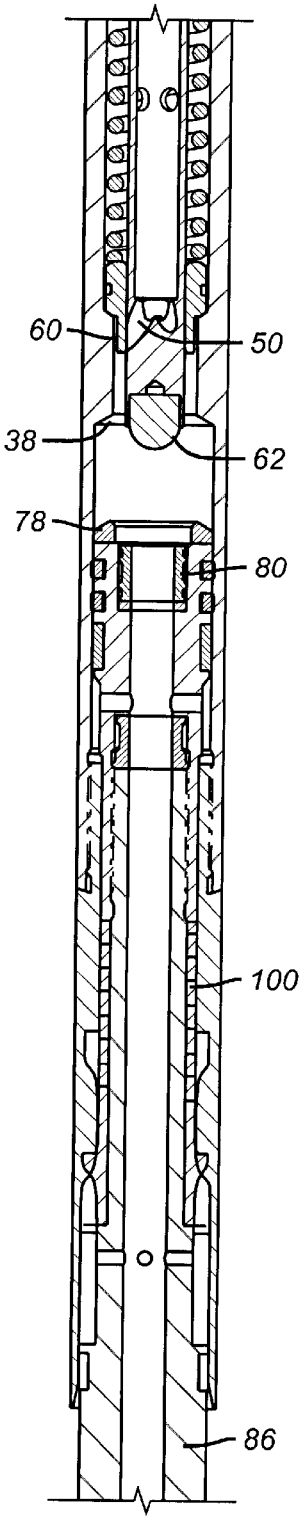
Figure 5B:
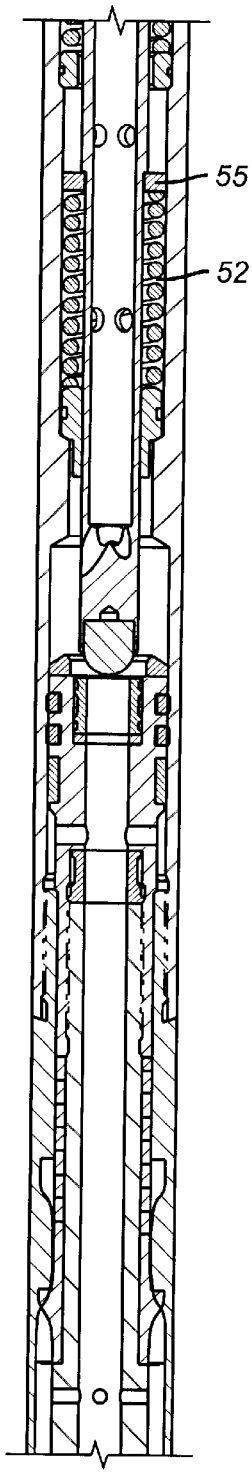
Figure 4C:
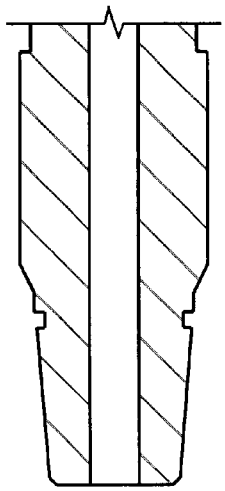
Figure 5C:
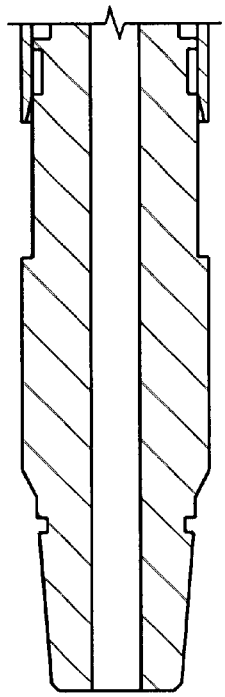

At some point, depending on the set down weight on top sub 10 the force from springs 52 and 54 overcomes the fluid pressure on piston 76 and carbide insert 62 lifts up from seat 80, as shown in FIGS. 4*a*–4*c*. As a result of flow being re-established, main barrel 34 is propelled down and dart body 46 is propelled up. As dart body 46 is propelled up, its lateral outlets 50 are obstructed by dart bushing 60. This obstruction acts as a fluid brake on the upward motion of dart body 46, because the rate of fluid passing through dart body 46 is dramatically reduced. This fluid brake is more reliable than shock bumpers used in past designs and wear on the cycling parts is reduced. Meanwhile, the rapid downward motion of helix housing 42 spins the coil clutch 92 in a manner so as to constrict spiral 100 on shaft 86. Since helix housing 42 is constrained against rotation around its longitudinal axis and at the same time it is engaged through the meshing of splines 44 and 96 and spiral 100 is gripping shaft 86, a turning force is imparted to shaft 86. At the end of the movement of the main barrel 34, shoulder 38 delivers a downward jarring blow to impact ring 78. The tool now resumes the position in FIGS. 2*a*–2*c* for another cycle.

Figure 6A:
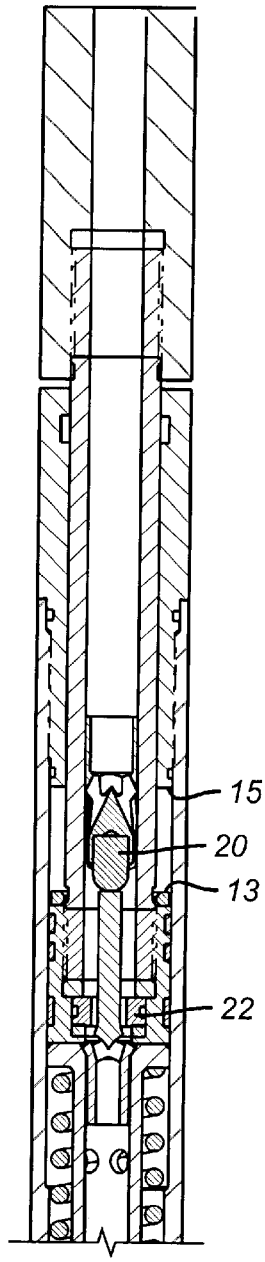
FIGS. 6*a*–6*c* are the view of FIGS. 5*a*–5*c* shown after the built up pressure is released and before delivery of the upward jarring blow.
Figure 6B:
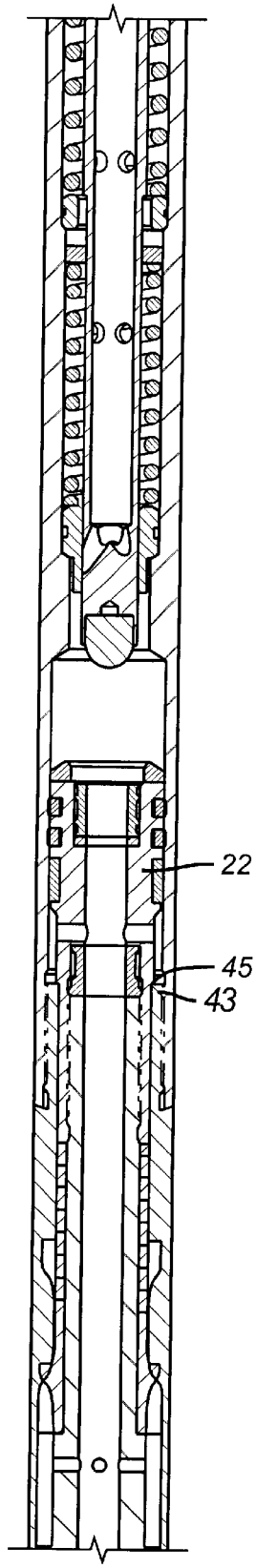
Figure 6C:
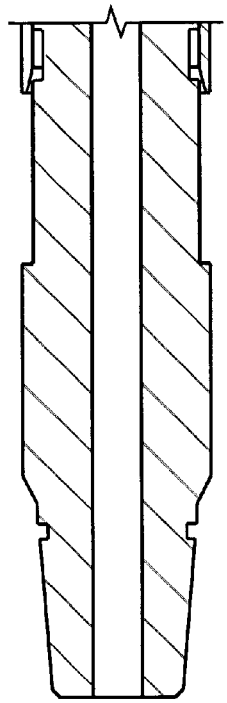

FIGS. 1*a*–1*c* also show the position of the tool connected to a downhole stuck object (not shown) at lower end 90 and an upward pull applied through the tubing to top sub 10. In this position, valve member 20 is on or near upper seat 22. If valve member 20 is not on seat 22, turning the pump on will drive it the rest of the way to contact. Pressure can now build on impact cap 24, which moves in tandem with valve member 20. As this is happening, the string (not shown) is being further tensioned as impact ring 13 moves away from shoulder 15. Valve member 20 pushes down on pin 72, which drives down dart body 46 to compress the springs 54 and 52 via stop 55 and flange 58. Eventually springs 54 and 52 provide enough force to allow pin 72 to displace valve member 20 from seat 22. Flow can resume through impact cap 24 and the tension held in the tubing string (not shown) connected to top sub 10 drives up top sub 10, upper shaft 12, and impact ring 13 mounted to it. Impact ring 13 hits shoulder 15 on upper sub 32 to deliver the upward jarring blow. From the position in FIGS. 6*a*–6*c* the tool returns to the position of FIGS. 1*a*–1*c*. It should be noted that stretching out the tool for an up jar, as shown in FIGS. 1*a*–1*c*, puts the upper end 43 of helix housing 42 in contact with shoulder 45 on piston 76 so that the up jarring blow passes from impact ring 13 to upper sub 32, to main barrel 34, to helix housing 42 that is now shouldered on shoulder 45 to communicate the up jarring blow to the piston 76.

Coil clutch 92 can be omitted from the apparatus A if it is to be used purely as a jarring tool and not for drilling. Doing this will eliminate the turning force applied to shaft 86 but it will still get the downward jarring blows when impact shoulder 38 hits impact ring 78. The apparatus A is a modular construction that allows it to be configured for jar up only, jar down only, jar up and down with no rotation, or jar down with rotation. Higher wearing components are simply removed from the assembly before use to get the desired effect. To eliminate up jarring, valve member 20 is removed. To eliminate down jarring carbide insert 62 or/and seat 80 are removed. To eliminate rotation, coil clutch 92 is removed.

Apart from the modular nature of the apparatus A, it delivers rotational force in a more reliable manner than the pin following a spiral slot technique used in U.S. Pat. No. 4,958,691. The meshing of inclined splines 44 and 96 is a far stronger connection that can stand up to the high cycle rates experienced by the apparatus A. The clutching action is also significantly more reliable than the array of cams used in that same prior art patent. The coil clutch 92 can have its spiral 100 made from a coil spring, a braided weave that exhibits action akin to the well known finger trap, or from a cylinder that is helically cut by a variety of techniques one of which could be laser cutting. It can have a single or multiple helixes. The cylinder could be cut in other patterns, which respond to rotation in opposed directions by an increase or decrease in diameter. Different materials can be used for coil clutch 92 and surface treatments can also be incorporated to improve grabbing action upon constriction or engagement. Other ratchet mechanisms to obtain the clutching action for single direction rotation are also contemplated within the scope of the invention.

In another feature of the invention, a single spring can be used instead of coil springs 52 and 54. Other spring types such as Belleville washer stacks, compartments with compressible gases and fluid chambers with controlled leakage rates can be used as the source that provides the force to allow flow to resume, setting the stage for a jar in the up or down direction. To reduce tool length, a single spring system or equivalent system acts as the force to allow flow to resume, whether jarring in the up or the down directions. This is to be compared to other tools such as the jar tool shown in U.S. Pat. No. 5,803,182 that requires discrete springs for the jar up valve and the jar down valve, thereby adding complexity and length to the tool.

The apparatus A features shock absorbing rings 30 and 84 which can be made from a variety of metallic and non-metallic materials compatible with the anticipated temperature and fluid conditions found for the particular application. The rings can be solid or in segments and can have a variety of cross-sectional shapes. Their purpose is to absorb shocks on their respective seats 22 and 64 from the frequent cycling experienced in these types of jars. These rings are not the only form of shock absorbers in the apparatus A. The dart body 46 is accelerated upwardly during down jarring when the carbide insert 62 lifts off seat 64. Rather than having such rapid acceleration stopped by repeatedly striking a fixed object, as depicted for example in U.S. Pat. No. 4,958,691, the apparatus of the present invention uses the rushing fluid through the dart body 46 as a hydraulic brake, as openings or lateral outlets 50 become temporarily obstructed by dart bushing 60 to rapidly decelerate the dart body 46 as it approaches impact cap 24. There need not be a collision of these parts before a return of the dart body 46 to the neutral position. Wear on the parts from cyclic impacts is reduced, if not totally eliminated. It should be noted that other materials could be used for valve action instead of carbide, as mentioned for insert 62 without departing form the invention. The apparatus A can be used with or without known designs of accelerators, typically used with jars in shallow depths.

The foregoing disclosure and description of the invention are illustrative and explanatory thereof, and various changes in the size, shape and materials, as well as in the details of the illustrated construction, may be made without departing from the spirit of the invention.

I claim:

1. A jarring tool for opposed jarring directions, comprising:

a body:

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction; and a second piston mounted for relative movement with respect to said body and having a second valve seat and a second valve member assembly in selective contact with said second valve seat until said bias force acting on said first valve member assembly moves said second valve member assembly out of contact with said second valve seat to allow a jarring force to be imparted to said first piston in a second direction opposite said first direction.

2. The jarring tool of claim 1, wherein:

said first valve member assembly having a passage for fluid flow, whereupon movement of said first valve member assembly off said first valve seat due to said bias force or movement of said second valve member assembly off said second valve seat due to said bias force on said first valve member assembly, said body obstructs at least in part, said passage to provide a fluid brake on said first valve member assembly.

3. The jarring tool of claim 2, further comprising:

a clutch between said body and said first piston to selectively engage said first piston to said body only when said relative movement is in a first direction.

4. The jarring tool of claim 3, wherein:

said relative movement in said first direction causes said clutch to constrict onto said first piston.

5. The jarring tool of claim 4, wherein:

said clutch comprises at least one coil.

6. The jarring tool of claim 3, wherein:

said clutch and said body further comprise mating inclined splines, such that said relative movement in said first direction imparts a rotation through said splines to said first piston apart from said jarring blow in said first direction.

7. The jarring tool of claim 3, wherein:

at least one of said first and second seats are mounted on a shock absorber.

8. A jarring tool, comprising:

a body;

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction;

a clutch between said body and said first piston to selectively engage said first piston to said body only when said relative movement is in a first direction; and said clutch comprises at least one coil that selectively engages said body to said piston by changing its diameter.

9. The jarring tool of claim 8, wherein:

said relative movement in said first direction causes said coil to constrict onto said first piston.

10. The jarring tool of claim 9, wherein:

said clutch and said body further comprise mating inclined splines, such that said relative movement in said first direction imparts a rotation through said splines to said first piston apart from said jarring blow in said first direction.

11. A jarring tool, comprising:

a body;

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction;

a clutch between said body and said first piston to selectively engage said first piston to said body only when said relative movement is in a first direction; and said clutch comprises at least one coil;

a second piston mounted for relative movement with respect to said body and having a second valve seat and a second valve member assembly in selective contact with said second valve seat until said bias force acting on said first valve member assembly moves said second valve member assembly out of contact with said second valve seat to allow a jarring force to be imparted to said first piston in a second direction opposite said first direction.

12. A jarring tool, comprising:

a body;

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction;

said first valve member assembly having a passage for fluid flow, whereupon movement of said first valve member assembly off said first valve seat due to said bias force, said body obstructs at least in part, said passage to provide a fluid brake on said first valve member assembly;

a clutch between said body and said first piston to selectively engage said first piston to said body only when said relative movement is in a first direction; and said clutch comprises at least one coil.

13. A jarring tool, comprising:

a body;

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction;

said first valve seat is mounted on a shock absorber; a clutch between said body and said first piston to selectively engage said first piston to said body only when said relative movement is in a first direction; and said clutch comprises at least one coil.

14. The jarring tool of claim 13, wherein:

said first valve member assembly having a passage for fluid flow, whereupon movement of said first valve member assembly off said first valve seat due to said bias force, said body obstructs at least in part, said passage to provide a fluid brake on said first valve member assembly.

15. A jarring tool, comprising:

a body;

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction; and said first valve member assembly having a passage for fluid flow, whereupon movement of said first valve member assembly off said first valve seat due to said bias force, said body obstructs at least in part, said passage to provide a fluid brake on said first valve member assembly.

16. The jarring tool of claim 15, wherein:

said first seat is mounted on a shock absorber.

17. A jarring tool, comprising:

a body;

a first piston mounted for relative movement with respect to said body and having a first valve seat;

a first valve member assembly movably mounted in said body for selective contact with said first valve seat, said first valve member assembly biased out of contact from said first valve seat by a bias force selectively resulting from a predetermined pressure buildup on said first piston to allow a jarring force to be imparted to said first piston in a first direction; and said first seat is mounted to said first piston on a shock absorber.

* * * * *